US006237290B1

(12) United States Patent
Tokimoto et al.

(10) Patent No.: US 6,237,290 B1
(45) Date of Patent: May 29, 2001

(54) HIGH-RISE BUILDING WITH LARGE SCALE DISPLAY DEVICE INSIDE TRANSPARENT GLASS EXTERIOR

(75) Inventors: Toyotaro Tokimoto; Masatoshi Oishi, both of Yokohama (JP)

(73) Assignees: Avix Inc.; Qfront Co., Ltd., both of (JP)

( * ) Notice: Subject to any disclaimer, the term of this patent is extended or adjusted under 35 U.S.C. 154(b) by 0 days.

(21) Appl. No.: 09/428,328

(22) Filed: Oct. 27, 1999

(30) Foreign Application Priority Data

Oct. 27, 1998 (JP) ..... 10-305658
Jan. 6, 1999 (JP) ..... 11-001382

(51) Int. Cl.[7] ..... E04H 1/00
(52) U.S. Cl. ..... 52/236.3; 52/235; 40/452
(58) Field of Search ..... 40/452, 451, 550, 40/564; 52/236.3, 235, 64

(56) References Cited

U.S. PATENT DOCUMENTS

| | | | | |
|---|---|---|---|---|
| 4,358,761 | | 11/1982 | Iwasaki . | |
| 4,365,245 | | 12/1982 | Colmenero . | |
| 4,386,351 | | 5/1983 | Lowdenslager . | |
| 4,460,142 | | 7/1984 | O'Rorke . | |
| 4,750,130 | | 6/1988 | Shimamura et al. . | |
| 4,791,744 | * | 12/1988 | Skalski | 40/452 X |
| 4,806,924 | | 2/1989 | Giraud et al. . | |
| 4,970,502 | | 11/1990 | Kunikane et al. . | |
| 5,162,696 | | 11/1992 | Goodrich . | |
| 5,239,798 | * | 8/1993 | Saito | 52/235 |
| 5,302,965 | | 4/1994 | Belcher et al. . | |
| 5,333,428 | * | 8/1994 | Taylor et al. | 52/235 X |
| 5,347,779 | * | 9/1994 | Jordan | 52/235 X |
| 5,390,093 | * | 2/1995 | Himeno et al. | 40/452 X |
| 5,641,141 | | 6/1997 | Goodwin . | |
| 5,650,794 | | 7/1997 | Walsh . | |
| 5,767,822 | | 6/1998 | Hiroshi . | |
| 5,809,676 | * | 9/1998 | Sukumoda et al. | 40/452 |
| 5,900,850 | | 5/1999 | Bailey et al. . | |
| 5,996,263 | * | 12/1999 | Black | 40/452 |
| 6,000,812 | * | 12/1999 | Freeman et al. | 40/452 X |
| 6,028,582 | * | 2/2000 | Drew et al. . | |

FOREIGN PATENT DOCUMENTS 10-268799 10/1998 (JP) .

* cited by examiner

*Primary Examiner*—Jose V. Chen
(74) *Attorney, Agent, or Firm*—Pennie & Edmonds LLP

(57) ABSTRACT

A high-rise building with a large scale dot-matrix display device is disclosed. The glass panels arranged in rows and columns form a curtain wall structured transparent outer wall 12 extending over an exterior of a building 10. Each panel is installed apart from end portions of floor slabs to form a void space therebetween. A plurality of louver structured modules 22 are arranged within the void space in rows and columns to form a large scale display area. Each module 22 has a louver-like structure formed of a plurality of posts 24 arranged in substantially parallel relationship and a plurality of parallel, uniformly spaced beams 26 connecting said adjacent posts 24. A plurality of LED combination lamps 28 are mounted on each beam 26 at uniform pitches as those between the adjacent beams 26. The LEDs are driven by drive circuits disposed in each beam 26. The vertical guide members 44 are fixed to the end portions of the floor slabs 20. The guide members 44 are arranged substantially in parallel relationship so that the modules 22 are supported between the adjacent guides 44 at the both lateral sides thereof. A plurality of vertical mullion members 48 fixed to the vertical guide members 44 as spaced apart from each of the vertical guides 44, so that the glass panels 12 are supported therebetween.

18 Claims, 9 Drawing Sheets

HIGH-RISE BUILDING WITH LARGE SCALE DISPLAY DEVICE INSIDE TRANSPARENT GLASS EXTERIOR

BACKGROUND OF THE INVENTION

1. Field of the Invention

The present invention relates to a high-rise building with a large scale dot-matrix display device.

2. Description of the Related Art

Today numerous types and designs of display apparatus can be seen along city streets and buildings, and are utilized for various advertisement of goods and services or for delivering news. It would be undoubted that as a display screen becomes larger, it conveys more information and becomes more appealing. Taking this relationship into consideration, it would be sufficient to equip a large signboard with lamps for delivering non-changing information such as a picture or photograph with characters. However, for communicating variable and changing information, such a display should be used as a dot matrix CRT display which is capable of displaying changing characters and moving images.

Recently, large and small display panels with a number of high-intensity LEDs arranged vertically and horizontally are used widely. This type of display panels, whether small or large, have a substantially thick and solid structure. There are mounted electronic circuits on the back side of the panels to drive the LEDs arranged on the front side. There have been no idea that the one side can be seen from another through the panel or that lights located beyond the display can be seen from outside.

However, in today's planning and designing of commercial buildings and event halls with various types of facades such as a curtain wall, there arise needs for a super-large scale dot matrix display device maintaining visibility through the display device as well as the facade. obviously the above conventional display devices with a solid panel structure cannot be employed for this use.

The present applicants proposed a transparent display device which can be divided into panels which can satisfy the above needs, in the Japanese patent application No.9-68457 (dated on Mar. 21, 1997). That panel can be applied to middle and large scale buildings and the disclosure about the method of controlling the whole display in the above application can be utilized to the present application. But if the display device is very large and the building which the device is applied to is very high, there comes a problem about how to construct and maintain the device.

SUMMARY OF THE INVENTION

It is an object of the present invention to propose a high-rise building with a large scale display device on its exterior which can be constructed and maintained easily.

According to one aspect of the present invention, a large scale display device can be constructed inside the transparent glass exterior by installing multiple modules in rows and columns. Each module has a louver structure, wherein the multiple beams are laid across the plural posts. Each beam has multiple LED lamps installed in its front panel at substantially uniform intervals. Thus, the modules can be transparent through the gaps between the beams, allowing to maintain good visibility through the display device as well as to let in the natural light from outside.

Especially when someone wants to see the outside from within the building with his eyes even, the horizontal beams will never obstruct his/her line of sight like an ordinary window shade. The posts of modules and the mullions adjacent thereto have just a little interference with a horizontal sight. Those vertical obstacles can be got rid of by proper choice of positioning and the orientation of his/her face.

Thus the transparent display device can maintain comfortable living space inside the building and create an appealing, wide variety of images shown on a large scale display area provided thereby.

Moreover, the relatively small modules can make it very easier to carry them, and constructing the whole display device as well as connecting cables and maintaining the device have also got eased. What is needed to improve the performance of the device is to replace the modules, there is no need to carry around and replace the other members of the building like glass wall, mullions and vertical guides. Thus, it can be accomplished to save natural resources and construction costs, and to reduce the construction time.

DESCRIPTION OF PREFERRED EMBODIMENTS

Overview of Building

Figure 1:
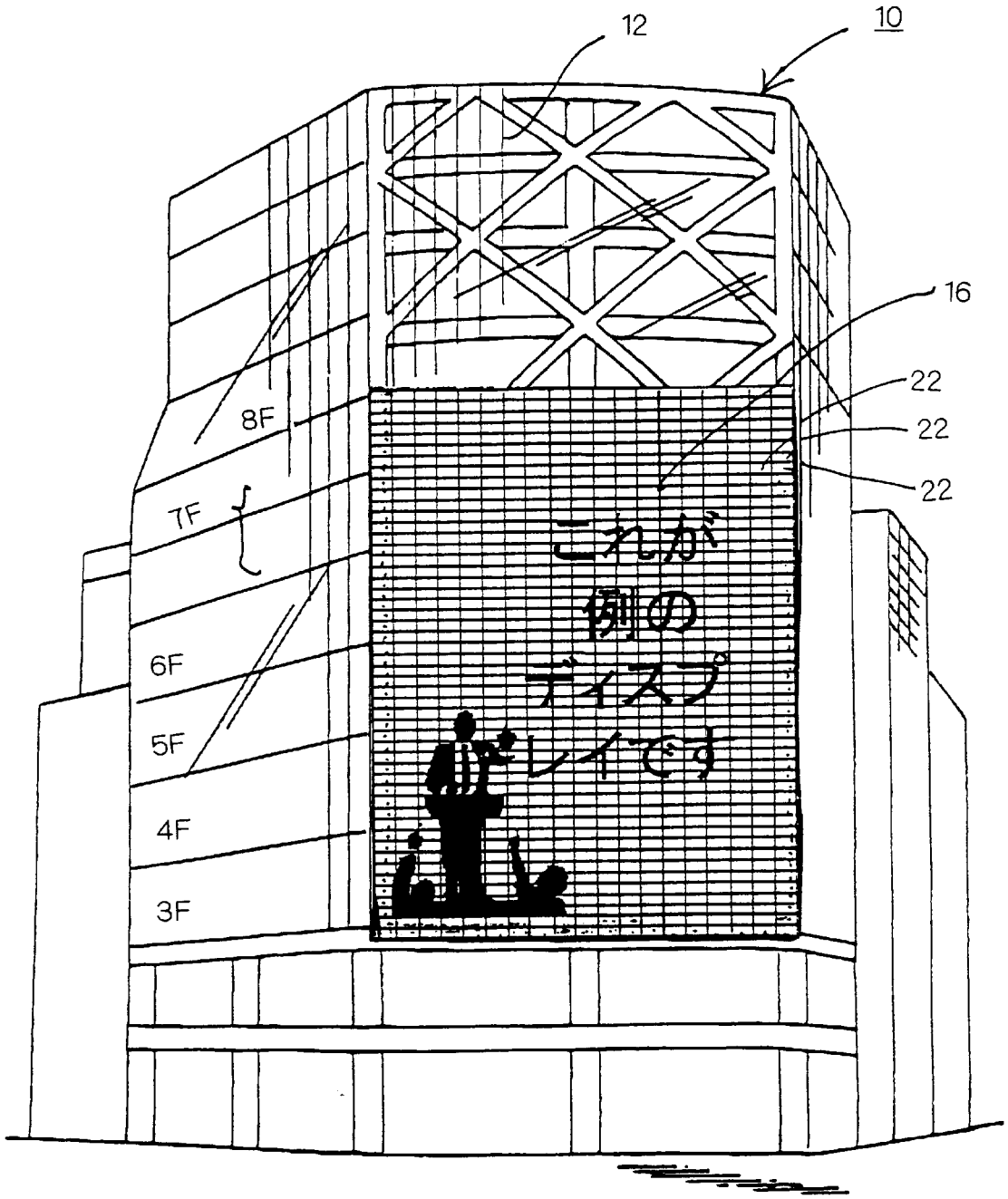
FIG. 1 is an external view of a facade of a high-rise building in accordance with the present invention.
Figure 2:
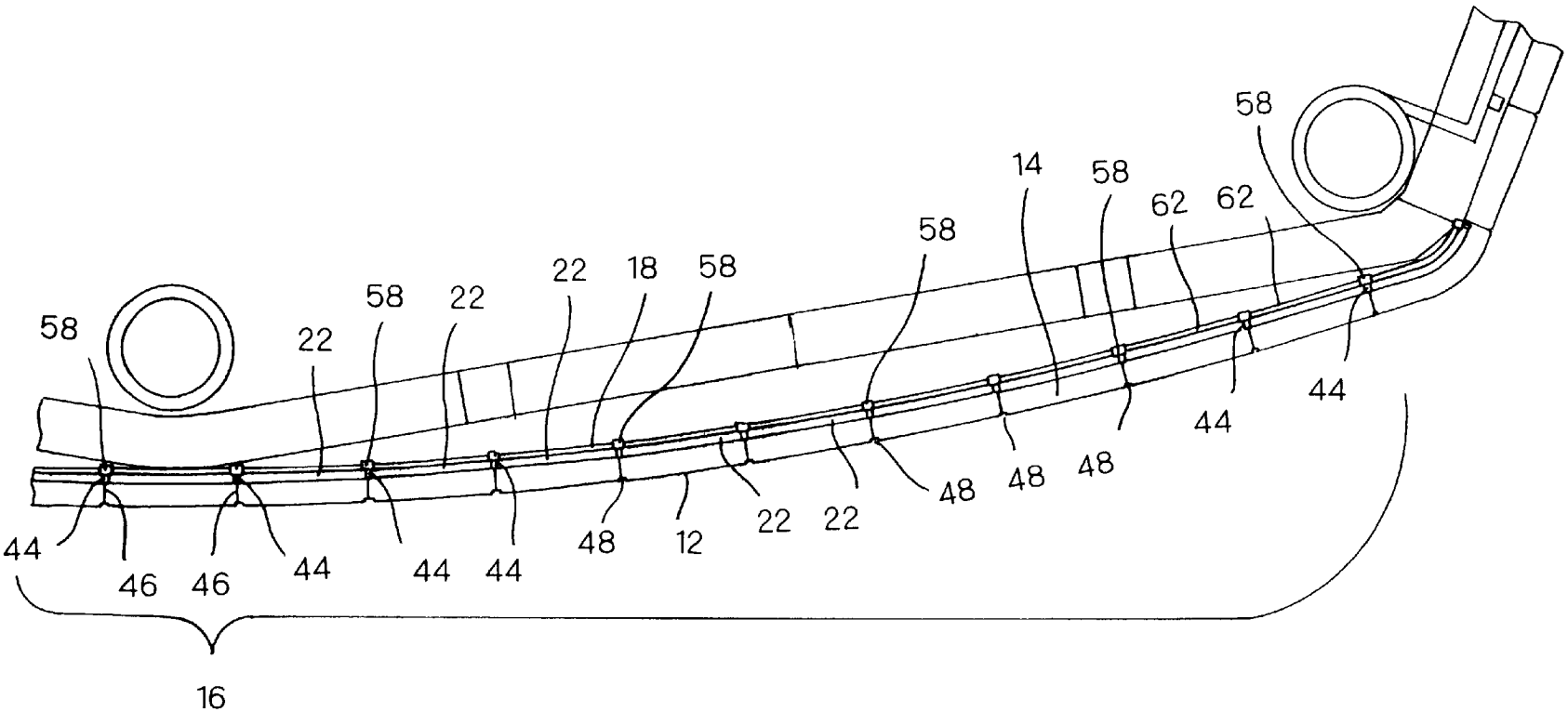
FIG. 2 is a detailed horizontal section view of the right half of the building around the outer wall shown in FIG. 1.

FIG. 1 shows an external view of a building 10 as one embodiment of the present invention. FIG. 2 shows an outline of the internal structure. The building has a curtain wall structure as its facade and is eleven stories high. The seventh floor is twice as high as any other floor, for it is to have a movie theater therein. The front facade is formed of a transparent outer glass wall 12. There is a void space (display space) 14 for installing a display device 16 inside the outer wall, extending from the third floor to the seventh. On the third to seventh floor's slabs 20, there constructed inner transparent glass walls 18 further inside of the display space. A large scale display device is installed within said display space, extending from the top of the third floor to the bottom of the eighth.

Outline of Large Scale Display Device

Figure 3:
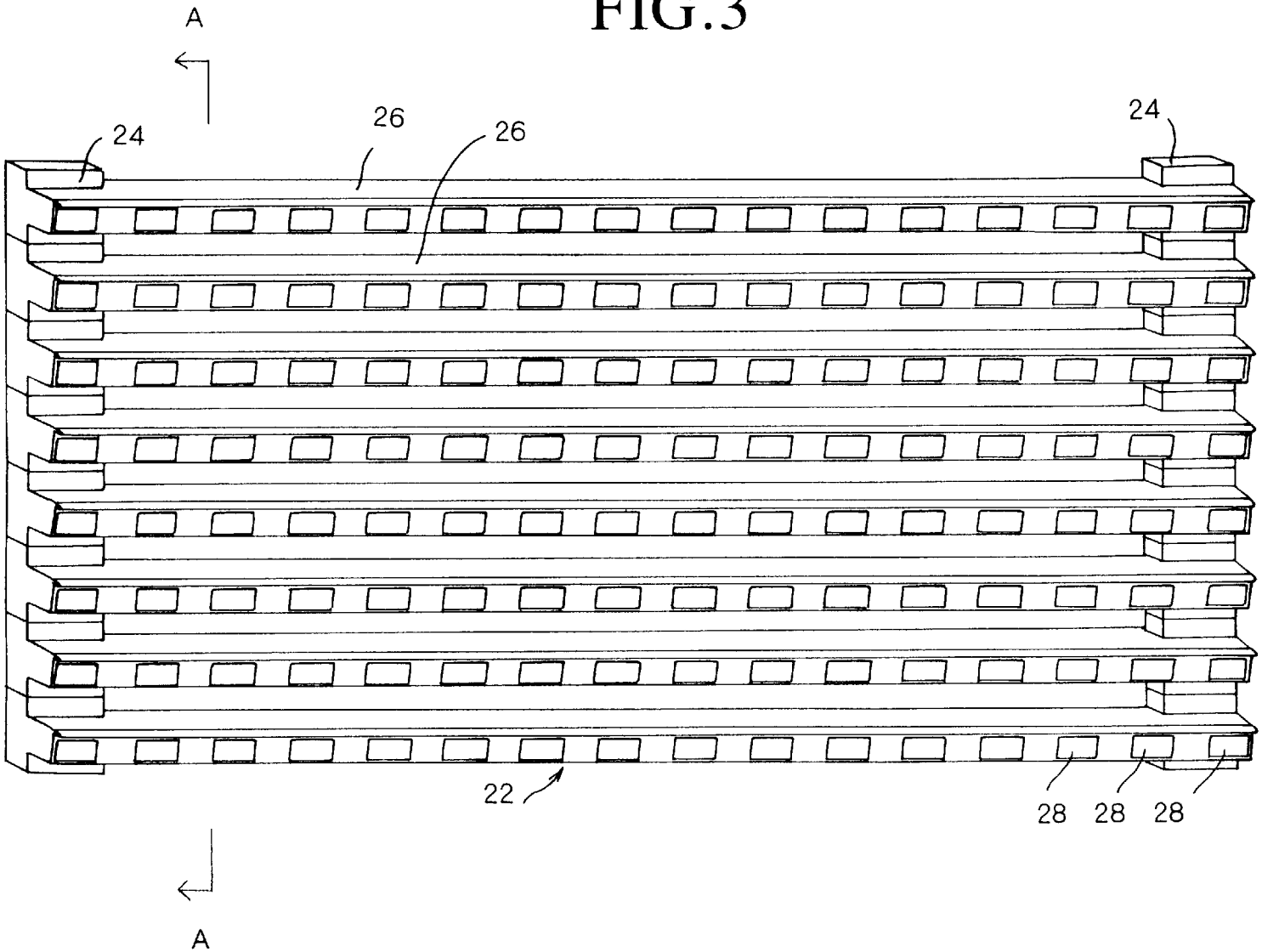
FIG. 3 is a schematic representation of one louver module of a display device to be installed on the building.

The display device 16 has a size of 25 m by 19 m. The display incorporates a 400 by 304 dot pattern, which means that the dots have a pitch of a little more than 6 cm in both directions. This display device comprises a number of louver structured modules 22, one of which is shown in FIG. 3. The module is approximately 50 cm high and 97 cm wide. The modules are arranged in 50 columns and 19 rows per column to form a large-scale 25×19-meter display which thus includes 950 modules in total.

Louver Structured Modules

Figure 4:
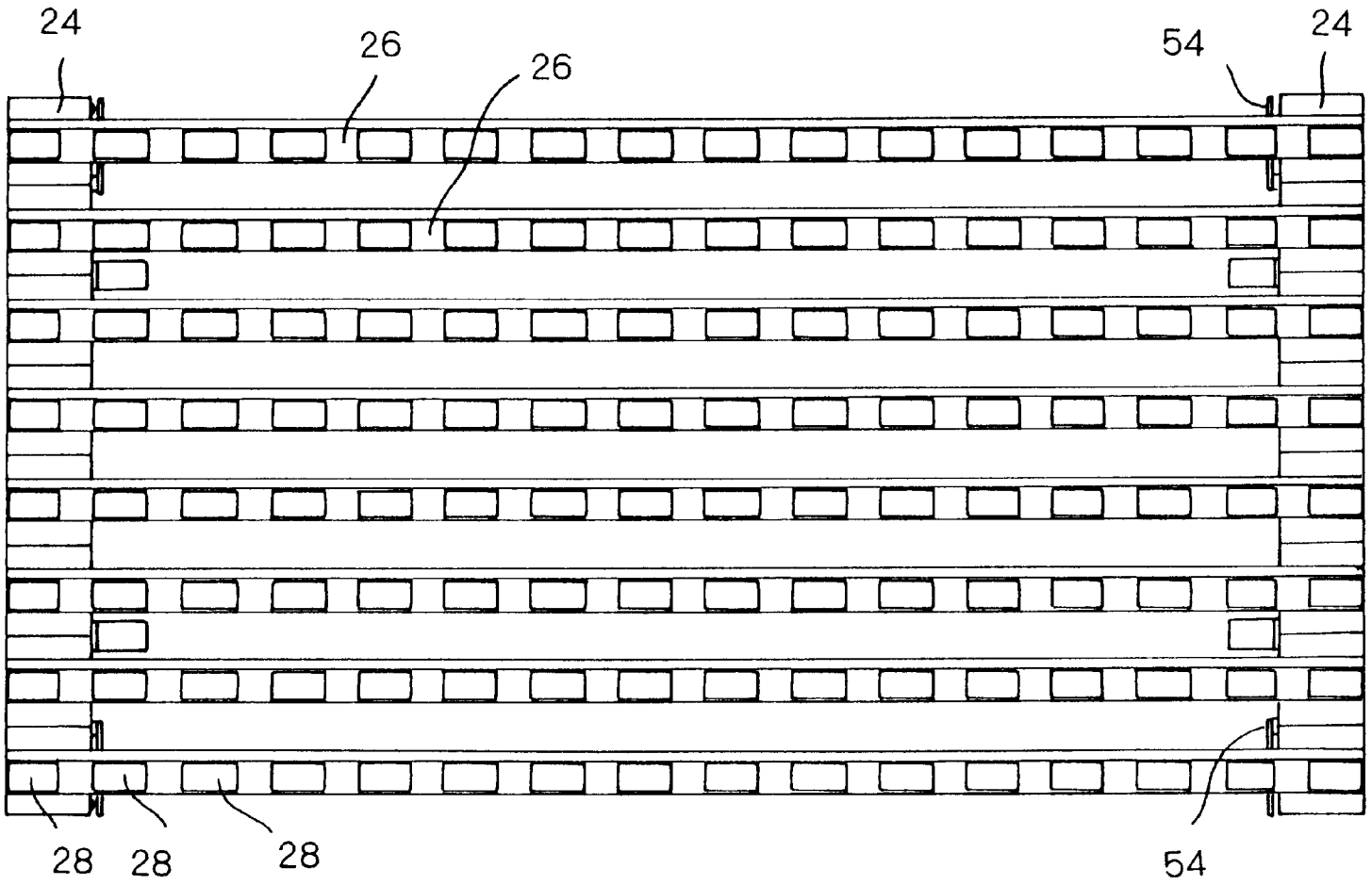
FIG. 4 is a front view of the module shown in FIG. 3.
Figure 5:
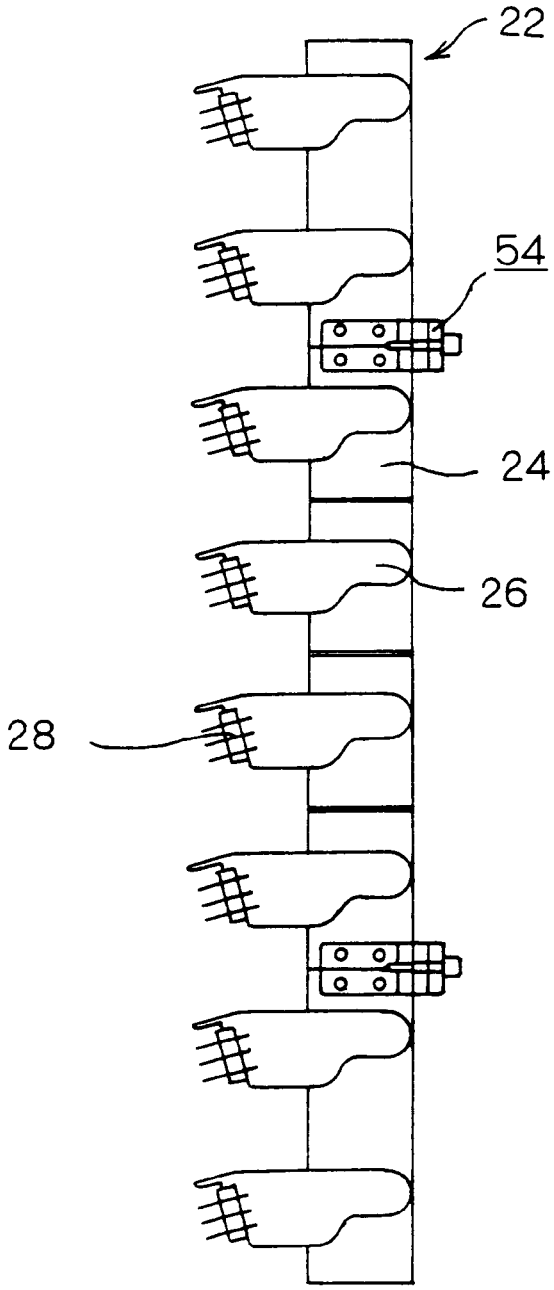
FIG. 5 is a section view taken along the line A—A shown in FIG. 3.

As shown in FIG. 3–FIG. 5, the louver structured module is an integrally formed structure comprising left and right posts 24 and eight horizontally parallel, uniformly spaced beams 26 connected thereto. Each beam has 16 LED lamps 28 mounted on its front panel 30 and corresponding drive circuits for each of the lamps. The lamps have uniform horizontal pitches, which are almost the same as those between the vertically adjacent beams. In this way, a louver structured module has 128 (=8×16) LEDs at uniform pitches both on the vertical and horizontal axes. The spaces between the adjacent beams are 32 mm wide, so that the visibility through the module are maintained when seen from apart.

Structure and Adjusting Angles of LED lamps

Figure 6A:
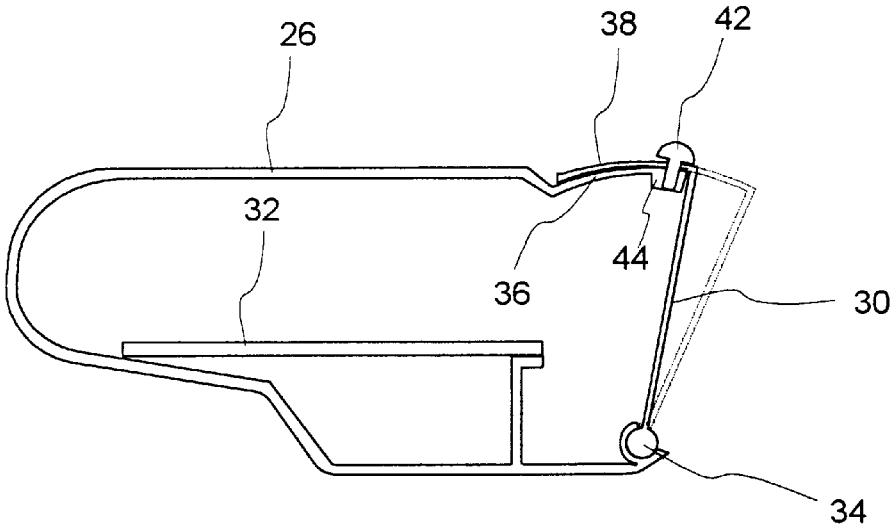
FIG. 6A is a section view of the beam of the module.
Figure 6B:
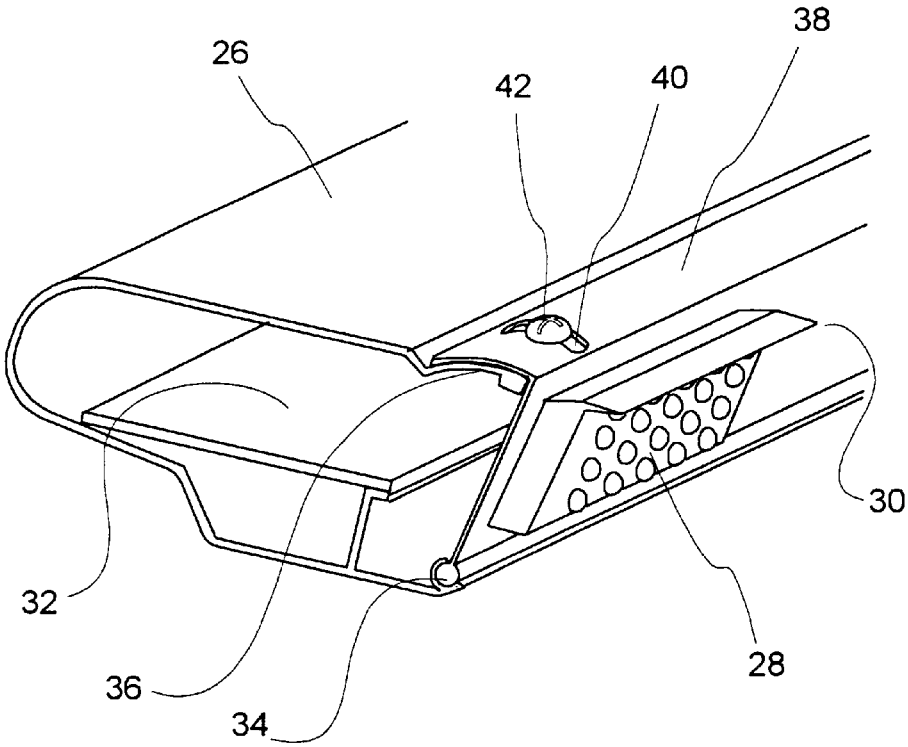
FIG. 6B is an enlarged perspective view of the FIG. 6A section.

FIGS. 6A and 6B show the structure of a beam with LED lamps. Each LED combination lamp comprises 20 diodes including red (R), green (G) and blue (B) ones. This combination of 20 LEDs form one pixel of the display system. The combination of lamps are so arranged as to form a substantially rectangular shape, which can be maintained when lighted in any one color of the lamps. The number of R, G and B lamp is decided properly in consideration of the balance when displaying white color, respectively. Each combination of LEDs has a corresponding drive circuit board 32.

A front panel 30 of the beam 26 pivots about the axis 34 which connects the front panel 30 and the bottom side of the beam 26 by means of a hinge structure, allowing to adjust the direction of the axis of the lamp's light. The beam 26 is an almost hollow-body item and contains such parts as drive circuits inside. A forwardly extending curvature (first curvature) portion 36 is formed in the upper front part of the beam 26, which corresponds to another curvature (second curvature) portion 38 formed in the upper part of the front panel 30, so that the second curvature can slide along over the first curvature. The second curvature portion 38 has slits 40 for bolts 42. The first curvature 36 has nut portions 44 formed at the front end thereof. The front panel 30 can be fixed at a proper angle by bolting the second curvature 38 to the first curvature 36.

The angle of light emitting direction (i.e. "light axis") can be adjusted, in this embodiment, from zero to 30 degrees below the horizontal line. Another method for adjusting the axis' angle is to choose the appropriate panel from various ones with different axis' angles.

The angle of the light axis can be adjusted according to the vertical level where the modules are located. In one example, the light axis of the module in the middle-height is directed at 15 degrees below. For the modules positioned lower, the light axes are so directed that the lower their locations are, the higher they are directed, and vise versa.

Constructing Modules and Surroundings

1. Constructing Outer Transparent Glass Wall

Figure 7:
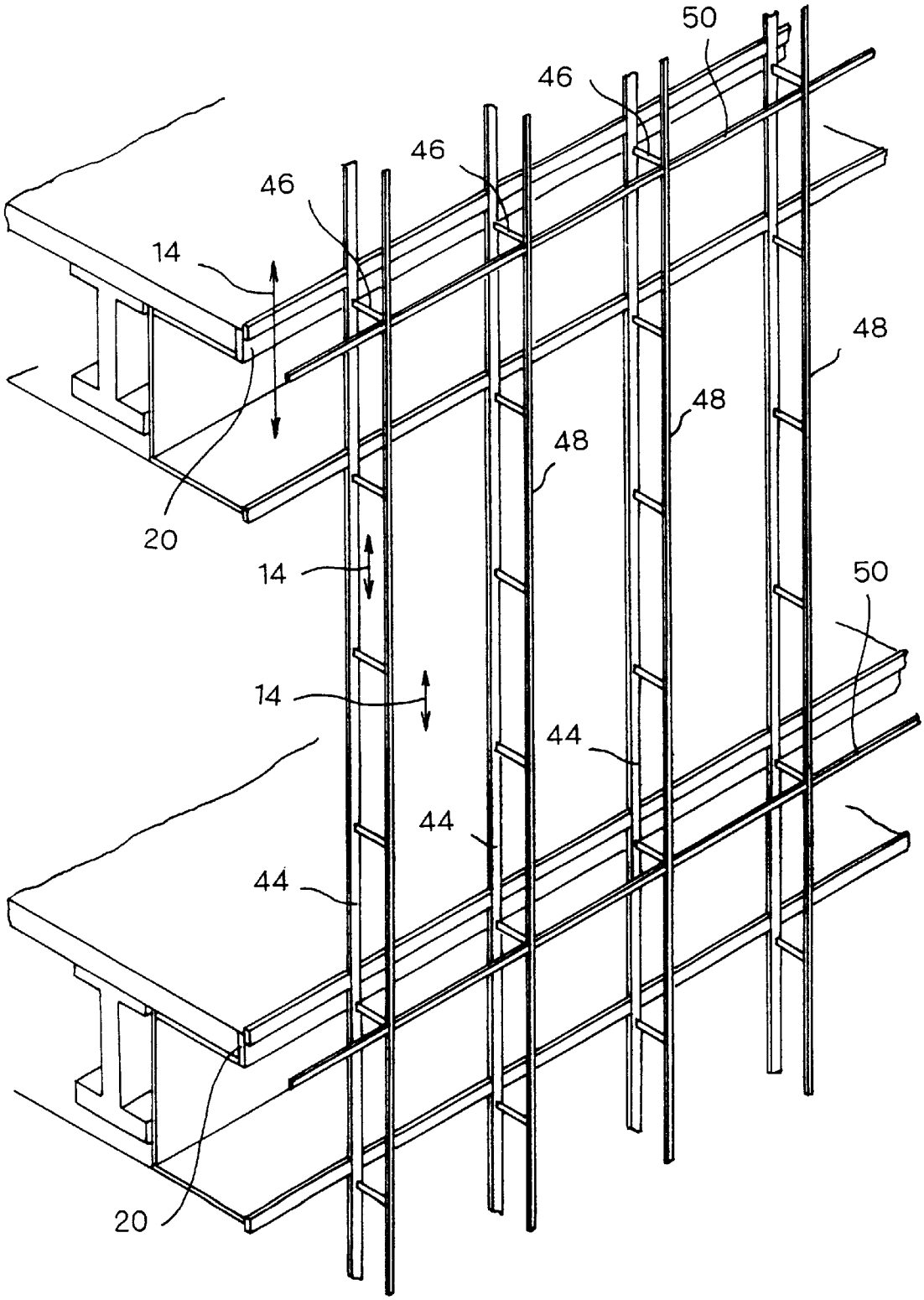
FIG. 7 is a schematic view of the void before the modules are installed.

FIG. 7 shows a schematic external view of the void space for constructing the display, with the modules being uninstalled yet. There installed vertical guide members 44 along an end portion of each slab 20 of the respective level at about one-meter intervals. Support members 46 are provided extending forwardly from the front surface of the vertical guide members 44. The support members 46 support vertical mullions 48 at their front ends. These guides and mullions are, for example, rail-shaped extrusions of aluminum. Between the adjacent mullions 48, horizontal lintels 50 are extended at predetermined vertical intervals. A panel of rectangular glass is installed within a set of adjacent two mullions and corresponding two lintels, being fixed by means of sash structure. Installing multiples of these glass panels will form the transparent glass wall. The void space between the inner surface of the glass wall and the slabs 20 forms the display space.

2. Carrying In and Installing Modules

Figure 8:
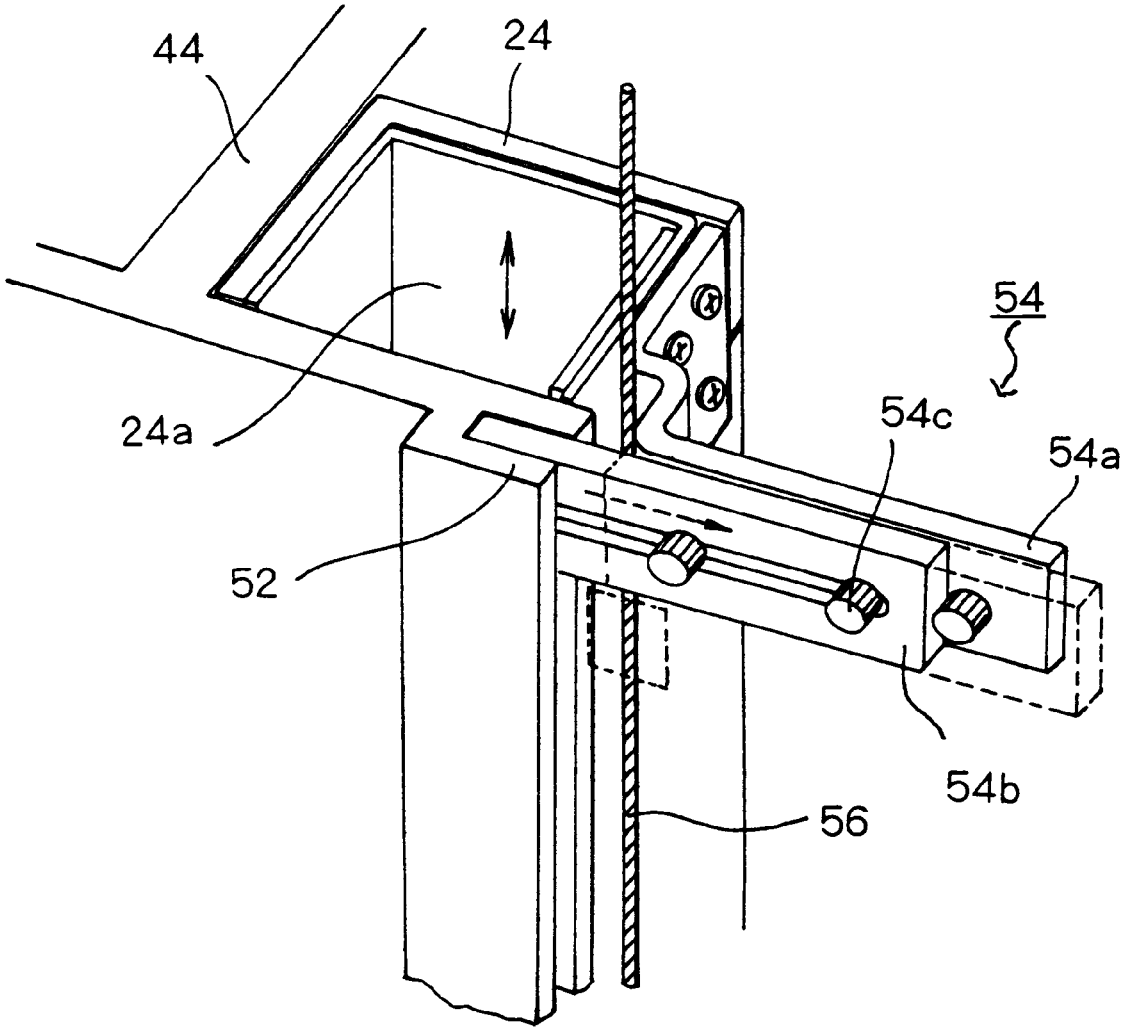
FIG. 8 is a schematic representation of installing the modules along the vertical guide.
Figure 9:
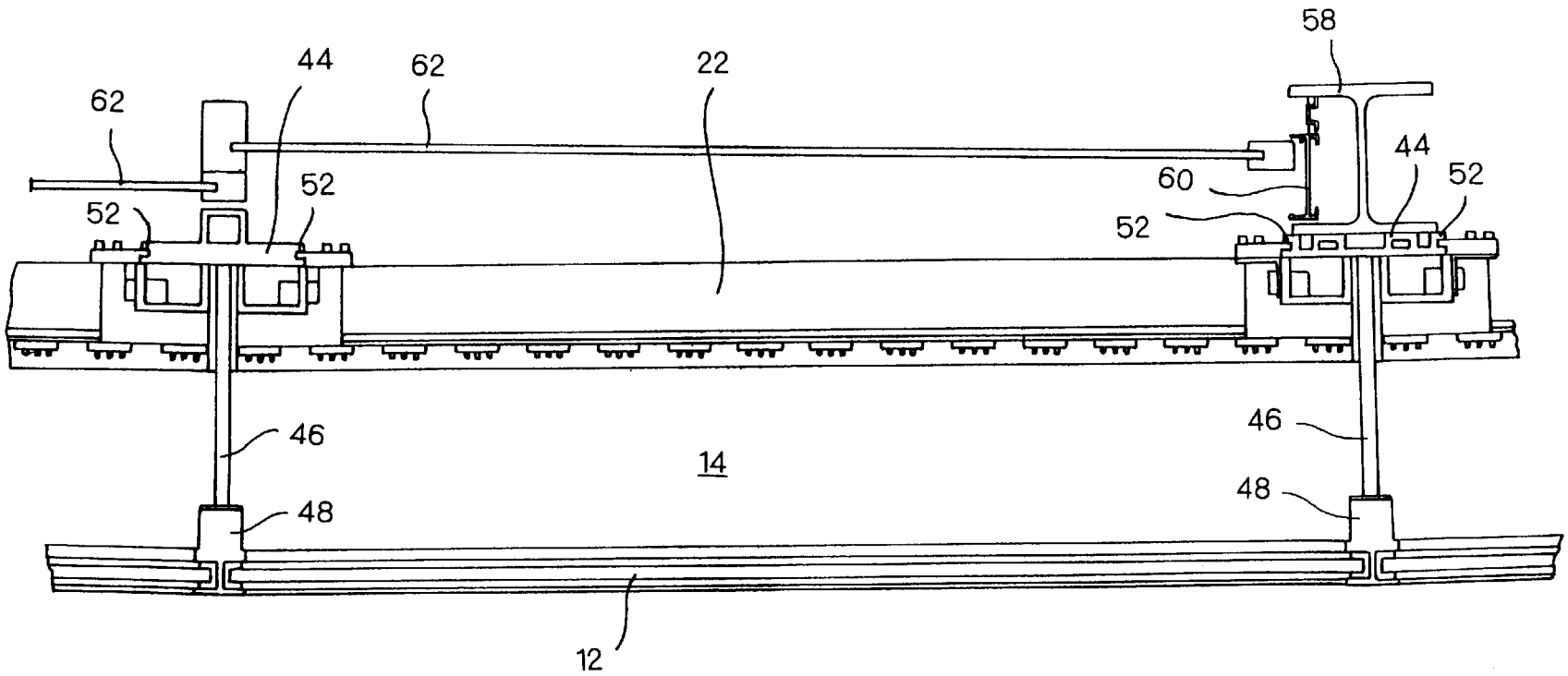
FIG. 9 is a detailed horizontal section view between the outer and the inner glass walls.

As shown in FIG. 8 and FIG. 9, the module is so installed inside the glass wall that the both horizontal sides are supported by the vertical guides 44. In both lateral sides of the guide, vertical channels 52 are provided. A latch structure 54, provided on both posts 24 of the module, comprises an arm 54*a*, a sliding member 54*b*, and fixing screws 54*c*. The modules can be carried in the building and constructed from inside of the floors. First one module is set between the guides 44 by means of engaging the sliding members 54*b* of the latches 54 into the vertical channels 52, so that the module is fixed in a horizontal direction, but a vertical slide motion thereof is still permitted. Then the module is hooked by wire 56 using a proper stopper, hanged from a pulley placed on a higher floor, and lifted up. Then another module is set directly below the first one, where the first one was located before lifted, again by means of engaging the latches 54 into the vertical channels 52. After repeating these steps until all of the modules for a certain floor are installed, the pulley is removed and the wire remains to support the modules. For further secure support of the modules, holder members, not shown in the figures, are provided extending forwardly from the vertical guide at proper intervals so that each holder can support right amounts of modules.

3. Connecting Power and Control Cables of Modules

There is a hollow space extending vertically within the post 24 of the module. The hollow portion has openings 24*a* at both vertical ends thereof. There are provided power and control cables, which are not shown, along the hollow portion in the post 24 and they are connected, around the openings 24*a*, to the cables from vertically adjacent modules. Every bottom ends of the cables arranged in the respective module posts 24 is properly terminated. Every top ends of cables in the module posts 24 is connected to the corresponding power and control unit (not shown) installed upon the eighth floor's slab.

4. Constructing Inner Transparent Glass Wall

The inner transparent glass wall is constructed on each floor separately. As shown in FIG. 9, H beams 58 are provided behind every other vertical guides 44. Each H beam 58 extends from the floor to the ceiling at every floor level. A sash 60 is installed between the adjacent H beams 58. A pair of horizontally sliding windows 62 with transparent glass panel is installed in the sash 60. All the sashes and glass windows will form the whole inner glass wall.

Options in Embodiments

As is publicly known, the building may have a structure that the outer glass wall is constructed without lintels.

When the horizontal dimension of the louver structured module is rather large so as to degrade the rigidity of the beam is rather low, the beam is liable to bend around the center. Several additional posts for supporting the beams may be provided at proper pitches to avoid the above drawback.

The method of establishing communication between the modules may be achieved by wireless, like an infrared communication, by means of providing the optical communication units in every module. The unit may be installed inside the beam 26, or preferably inside both ends of the post 24, where the modules are mechanically connected or come closest to each other. This wireless communication makes it very easy and simple to link the respective terminals of the control cables while installing the modules.

The power cables may be prepared as long, integrally formed cables which is as long as the height of a module post 24. The cable may be installed along the vertical guide 44 while or after the guide 44 is constructed. Each module may be connected to this power cable at corresponding connecting points.

Vertically sliding windows may be used as means of the inner glass wall, instead of horizontally sliding windows used in the above embodiment. Casement windows may also be chosen, if not be used for all of the window spaces, in consideration of the conditions of construction.

What is claimed is:

1. A high-rise building with a large scale dot-matrix display device comprising:

a plurality of glass panels arranged in rows and columns to form a curtain wall structured transparent outer wall extending over an exterior of the building, each of said panels being installed apart from end portions of floor slabs of the building to form a void space therebetween;

a plurality of louver structured modules arranged within said void space in rows and columns to form a large scale display area, each of said modules having a louver-like structure formed of a plurality of posts arranged in substantially parallel relationship and a plurality of parallel beams connecting said adjacent posts, said beams being uniformly spaced from each other at predetermined pitches;

a plurality of light emitting means mounted on each of said beams at uniform and generally the same pitches as those between said adjacent beams to form said large-scale dot-matrix display;

a plurality of drive circuits for driving the respective light emitting means installed in each of said beams;

a plurality of vertical guide members fixed to said end portions of the floor slabs, said vertical guide members being arranged substantially in parallel relationship so that said modules are supported between said adjacent guides at the both lateral sides thereof; and a plurality of vertical mullion members fixed to said vertical guide members as spaced apart from each of said vertical guides, so that said glass panels are supported therebetween.

2. A high-rise building with a large scale dot-matrix display device as set forth in claim 1, wherein a transparent inner glass wall is disposed at an inner proximity of said void space, said louver structured modules being disposed within said void space defined between said inner and exterior glass walls.

3. A high-rise building with a large scale dot-matrix display device as set forth in claim 1, wherein each of said light emitting means is disposed on said beam in a rotatable manner around a longitudinal axis of said beam, and axes of light emission of said light emitting means are shifted downward by rotating said light emitting means as said louver structured modules are positioned at higher levels of the building.

4. A high-rise building with a large scale dot-matrix display device as set forth in claim 1, wherein said light emitting means comprises a plurality of LEDs.

5. A high-rise building with a large scale dot-matrix display device as set forth in claim 1, wherein a plurality of support members are provided extending forwardly from the front surface of said vertical guide members for supporting said mullion members.

6. A high-rise building with a large scale dot-matrix display device comprising:

a plurality of transparent panels arranged in rows and columns to form a curtain wall structured transparent outer wall extending over an exterior of the building, each of said panels being installed apart from end portions of floor slabs of the building to form a void space therebetween;

a plurality of louver structured modules disposed within said void space and arranged in rows and columns to form said large scale display device, each of said modules having a louver-like structure formed of a plurality of vertical posts and a plurality of horizontal beams connecting said vertical posts;

a plurality of light emitting means mounted on each of said horizontal beams at predetermined pitches so as to form said large-scale dot-matrix display area;

a plurality of drive circuits disposed in each of said beams for driving the respective light emitting means mounted on said beams; and means for holding said modules within said void space.

7. A high-rise building with a large scale dot-matrix display device as set forth in claim 6, wherein a transparent inner wall is provided at an inner proximity of said void space and said louver structured modules are disposed within said void space defined between said inner and outer walls.

8. A high-rise building with a large scale dot-matrix display device as set forth in claim 6, wherein each of said light emitting means is disposed on said beam in a rotatable manner around a longitudinal axis of said beam, and axes of light emission of said light emitting means are shifted downward by rotating said light emitting means as said louver structured modules are positioned at higher levels of the building.

9. A high-rise building with a large scale dot-matrix display device as set forth in claim 6, wherein said light emitting means comprises a plurality of LEDs.

10. A louver structured module used for said high-rise building as set forth in claim 6.

11. A louver structured module used for said high-rise building as set forth in claim 1.

12. A high-rise building with a large scale dot-matrix display device comprising:

a transparent exterior wall arranged as spaced apart from end portions of floor slabs of the building;

a plurality of louver-like structured modules disposed between said transparent exterior wall and the end portions of the floor slabs of the building arranged in rows and columns to form a large scale display device inside the transparent exterior walls, each of said modules formed of a plurality of vertical posts and a plurality of horizontal beams connecting said vertical posts, each of said louver-like structured modules having a plurality of light emitting means mounted on each of said horizontal beams thereof at predetermined pitches so as to form said large-scale dot-matrix display;

a plurality of drive circuits disposed in each of said beams for driving the respective light emitting means mounted on said beams; and means for holding said modules between said transparent exterior wall and the end portions of the floor slabs of the building.

13. A high-rise building with a large scale dot-matrix display device as set forth in claim 12, wherein a transparent inner wall is positioned at said end portions of the floor slabs of the building and said louver structured modules are disposed within a void space defined between said inner and exterior walls.

14. A high-rise building with a large scale dot-matrix display device as set forth in claim 12, wherein each of said light emitting means is disposed on said beam in a rotatable manner around a longitudinal axis of said beam, and axes of light emission of said light emitting means are shifted downward by rotating said light emitting means as said louver structured modules are positioned at higher levels of the building.

15. A high-rise building with a large scale dot-matrix display device as set forth in claim 12, wherein said light emitting means comprises a plurality of LEDs.

16. A louver structured display module comprising:

a plurality of vertical posts arranged in substantially parallel relationship to each other;

a plurality of horizontal beams connecting said adjacent vertical posts, the adjacent horizontal beams being spaced apart at predetermined intervals in order to maintain visibility through said module;

a plurality of light emitting means mounted on each of said horizontal beams at predetermined pitches so as to form a dot-matrix display while maintaining visibility through said module; and a plurality of drive circuits disposed in each of said beams for driving the respective light emitting means mounted on said beams.

17. A louver structured display module as set forth in claim 16, wherein each light emitting means are disposed on the horizontal beam in rotatable manner around a longitudinal axis of the beam so that an axis of light emission of said light emitting means is changeable in an up-and-down direction.

18. A louver structured display module as set forth in claim 16, wherein said light emitting means comprises a plurality of LEDs.

* * * * *